US005395227A

United States Patent [19]

Huggins, Sr. et al.

[11] Patent Number: 5,395,227

[45] Date of Patent: Mar. 7, 1995

[54] ADJUSTABLE POWDER FLOW GATE FOR A ROTARY PELLET PRESS

[75] Inventors: Thomas B. Huggins, Sr.; Peter H. Beuchel, both of Columbia, S.C.

[73] Assignee: Westinghouse Electric Corporation, Pittsburgh, Pa.

[21] Appl. No.: 110,032

[22] Filed: Aug. 20, 1993

[51] Int. Cl.[6] ..... B30B 15/30

[52] U.S. Cl. ..... 425/145; 100/215; 141/144; 222/346; 222/370; 264/40.7; 425/217; 425/255; 425/259; 425/345; 425/353; 425/415; 425/447; 425/423

[58] Field of Search ..... 425/77, 112, 145, 215, 425/216, 217, 182, 253, 255, 344, 357, 352, 354, 415, 447, 449, 345, 355, 423, 259; 264/40.7; 100/215, 264, 906, 909; 222/346, 370; 141/144

[56] References Cited

U.S. PATENT DOCUMENTS

| | | | |
|---|---|---|---|
| 2,043,086 | 6/1936 | Westin et al. | 425/182 |
| 2,166,192 | 7/1939 | Whittemore | 425/215 |
| 2,798,443 | 7/1957 | Martell | 425/112 |
| 2,969,753 | 1/1961 | Abbe et al. | 425/215 |
| 2,992,729 | 7/1961 | Curtius | 425/345 |
| 3,029,470 | 4/1962 | Frank | 425/449 |
| 3,276,079 | 10/1966 | Cohn | 425/345 |
| 3,332,367 | 7/1967 | Sperry et al. | 425/216 |
| 3,566,806 | 3/1971 | Forster et al. | 425/449 |
| 4,157,148 | 6/1979 | White | 222/346 |
| 4,403,935 | 9/1983 | Crossley et al. | 425/215 |
| 4,813,818 | 3/1989 | Sanzone | 425/447 |

FOREIGN PATENT DOCUMENTS

| | | | |
|---|---|---|---|
| 1-224200 | 9/1989 | Japan | 425/447 |

*Primary Examiner*—Jay H. Woo
*Assistant Examiner*—Joseph Leyson

[57] ABSTRACT

An adjustable powder flow gate for a rotary pellet press has a movable gate wherein one dimensional motion of the gate across an opening in a powder flow feed frame on the rotating turret of the press is effected with a rotatable shaft having a screw connection to a member attached to the gate. The shaft is maintained in a selected rotational position with a bias member that is movable between an engaged and a disengaged position. The bias member is adapted to engage a selected detent on a member attached to the shaft having several circumferentially spaced detents when the bias member is in the engaged position. The shaft can freely rotate when the bias member is in the disengaged position. An operator can easily adjust the size of the opening by first disengaging the bias member from the selected detent, turning the shaft to move the gate to the desired position, and then engaging the bias member into a newly selected detent.

17 Claims, 5 Drawing Sheets

FIG. 3
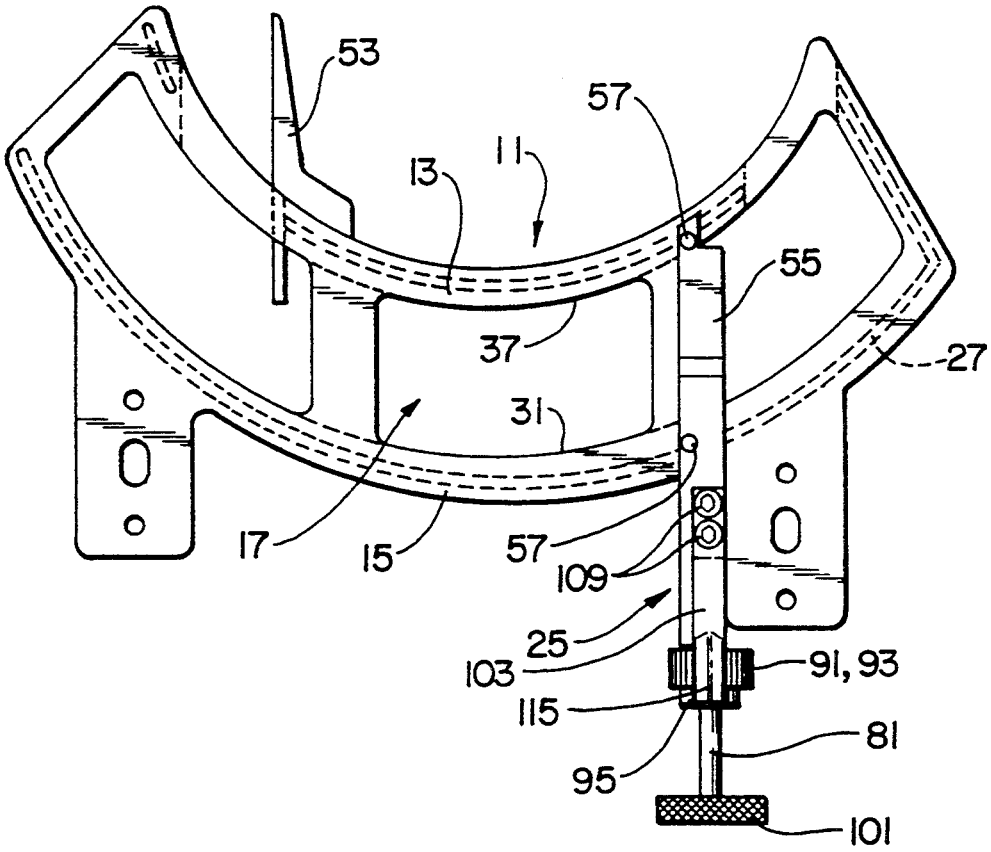
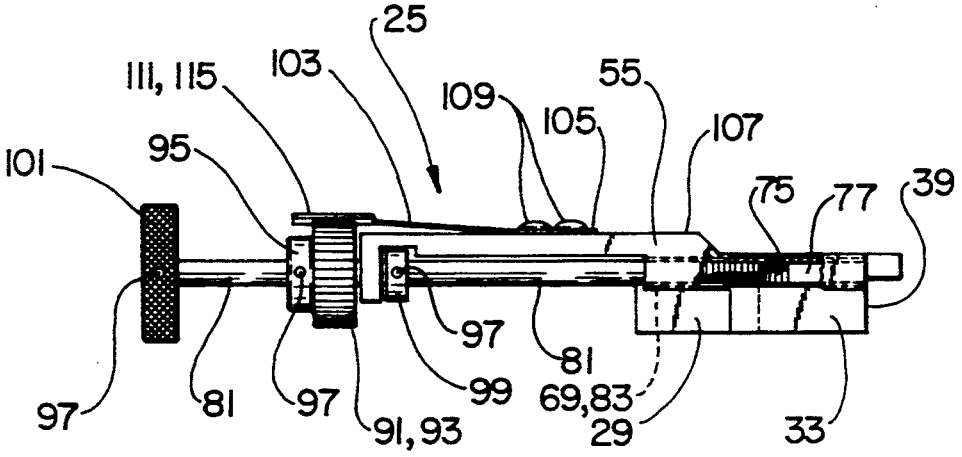
FIG. 4

ADJUSTABLE POWDER FLOW GATE FOR A ROTARY PELLET PRESS

BACKGROUND OF THE INVENTION

This invention relates to adjustable powder flow gates for rotary pellet presses and, more particularly, to adjustable powder flow gates having a spring loaded detent to maintain the gate in a fixed position during operation of the press.

Rotary pellet presses have been used for many years for such applications as forming pellets of medicines and the like and also in the nuclear power industry for forming pellets of uranium dioxide fuel for reactors. Rotary pellet presses generally have a rotatable turret having several dies at a fixed radius. A powder feed frame is positioned on top of a section of the turret, which rotates at about 10–24 rpm beneath the feed frame. The feed frame directs powder, or compacted granular material, that is dropped down by gravity from a feed chute to a limited area of the feed frame. An adjustable powder flow control gate attached to the powder feed frame provides adjustable control of the powder flow to ensure uniform die fill as the turret rotates beneath the feed frame. After passing the flow control gate, excess powder is wiped away from the die. The powder in the die is then compressed by punches from above and below the turret. The newly-formed pellets are pushed up out of the die and guided off the turret to a pellet take off disk by a bar angled in the pellet's path of motion.

The feed frames of the prior art suffer serious disabilities from their design. The flow control gates of the prior art are simple pieces of sheet metal formed so that the gate is oriented 90 degrees from the flat surface of the turret. A first piece of sheet metal is in a fixed position across a portion of the path of powder flow in the feed frame. A second, movable piece is attached to the first piece by a pair of mounting screws that fit through a slot in the second, movable piece. The gate is fastened to the feed frame and crude adjustment is accomplished by loosening the two mounting screws, moving the movable piece of the metal gate, and tightening the screws. This apparatus and method is imprecise. The sequence of loosening the screws, adjusting the gate and tightening the screws is a difficult operation because the press generally must be stopped during the sequence. Even though the press is stopped during the adjustment, the operator must reach into an area of the press where there are potentially hazardous powders. The effect of the adjustment is unknown until the press is restarted and some new product can be inspected. In addition, the screws often loosen as a result of vibrations of the operating press. Consequently, gate settings can spontaneously change, causing die fill inconsistencies, resulting in undesirable fluctuations of pellet density. This is a serious problem in the nuclear industry, where density tolerances are especially stringent.

There is therefore a need for a better means for adjusting and controlling powder flow to ensure uniform die fill in a rotary pellet press.

SUMMARY OF THE INVENTION

It is an object of this invention to provide an apparatus that allows a rotary pellet press operator to make precise adjustments to the opening of a powder flow control gate on a feed frame.

It is another object of this invention to provide an apparatus for adjusting a powder flow control gate on a rotary pellet press that will not tend to go out of adjustment by vibrations during normal operation of the press.

It is yet another object of this invention to provide a speedy and precise method for adjusting a powder flow control gate on a rotary pellet press.

It is yet another object of this invention to provide an adjustable powder flow gate that has repeatable settings.

It is another object of this invention to provide an adjustable powder flow gate for a rotary pellet press that can be adjusted by an operator with one hand while the press is operating.

These objects and others are accomplished with the present invention for an adjustable powder flow gate for a rotary pellet press. A rotary pellet press has a rotatable turret having a flat upper surface on which powder is deposited by a vibration enhanced gravity feed chute. There are several circumferentially spaced dies recessed flush into the turret from openings in the upper surface. The feed chute deposits the powder in a feed frame that is in a fixed position adjacent the upper surface of the turret. The feed frame has radially spaced apart inner and outer walls, the inner wall being closer to the center of the turret than the outer wall, defining a channel therebetween. As the powder is deposited, it fills dies as they pass through the channel with the rotating turret. Mounted transverse to the turret surface on the feed frame is a powder flow gate according to the present invention that wipes excess powder away from the filled dies and adjusts the size of an opening through which the excess powder passes out of the channel of the feed frame.

The adjustable powder flow gate includes a blade-like first member that is capable of linear movement across the opening so as to change the size of the opening. Movement of the first member is effected by an adjustable screw means that includes a rotatable shaft having a screw connection to the first member, first means connected to the feed frame for maintaining the shaft in a fixed translational position, and second means for maintaining the shaft in a selected rotational position.

According to a further aspect of this invention, the second means for maintaining the shaft in a selected rotational position includes a detent member fixedly mounted on the shaft. The detent member includes a plurality of circumferentially spaced detents on a radius coaxial with the shaft, such as the detents between adjacent teeth of a toothed gear. Bias means connected to the feed frame includes a bias member that is movable between first and second positions. The bias member engages a selected one of the detents in the first position for maintaining a selected rotational position. The bias member disengages from the selected detent in the second position, allowing an operator to rotate the shaft, thereby adjusting the position of the first member and thus the size of the opening. The new position is maintained by engaging a newly selected detent with the bias member.

According to yet another aspect of the invention the potential energy of the second means for maintaining the shaft in a selected position is lower in the first position of the bias member than in the second position. For example, the bias member can be a vertically positioned pin that drops via gravity or via action of a spring from the second position to the first position, or the bias member can be an elongated leaf spring that is less tensioned in the first position than in the second position.

According to yet another aspect of the invention, the first means for maintaining the translational position of the shaft includes an elongated member mounted on the feed frame so as to bridge the channel. The elongated member includes spaced apart first and second shaft guides for carrying the shaft and restricting movement of the shaft transverse to the shaft axis. The first shaft guide is located on an arm extending transversely from an end of the elongated member and positioned radially outside the outer wall of the feed frame. The arm has spaced apart inner and outer surfaces. The first means also includes first and second annular members fastened to the shaft. The toothed gear is connected to the first annular member and positioned adjacent the outer surface of the arm, and the second annular member, or shaft collar, is positioned adjacent to the inner surface of the arm, thus limiting axial translation of the shaft.

Means for preventing rotation of the movable gate by rotation of the shaft are also provided according to another aspect of this invention, wherein the elongated member has a slot in which the second blade is positioned off a rotational axis defined by the axis of the shaft. The slot tracks the linear path of movement of the movable gate, thus further restricting rotations of the gate on other axes of rotation.

BRIEF DESCRIPTION OF THE DRAWINGS

FIG. 3 is a plan view of the adjustable powder flow gate of FIG. 1 and FIG. 2 mounted to a feed frame.

FIG. 4 is a side elevation view of an adjustable powder flow gate of the present invention.

DETAILED DESCRIPTION OF THE INVENTION

Figure 1:
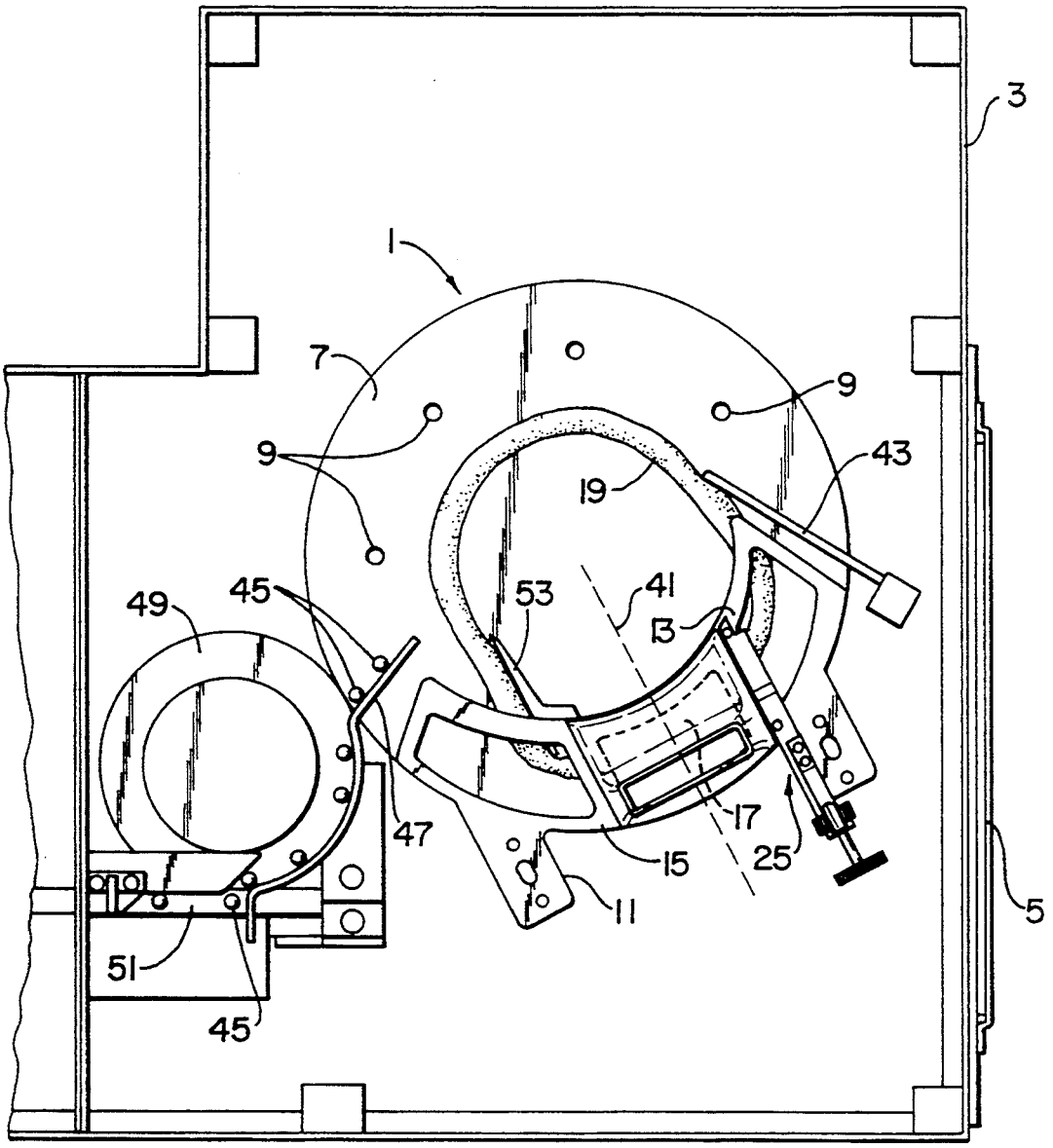
FIG. 1 is a plan view of a rotary pellet press having an adjustable powder flow gate of the present invention.
Figure 2:
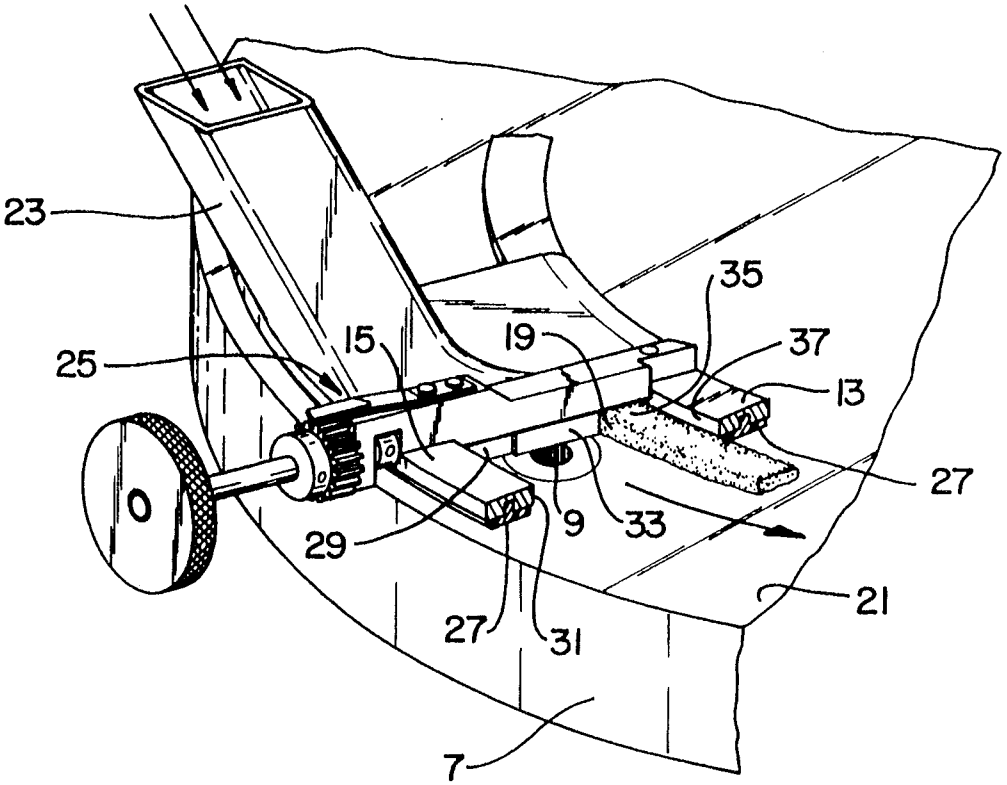
FIG. 2 is a perspective view of a portion of a rotary pellet press of FIG. 1 featuring the feed frame and powder flow gate.
Figure 5:
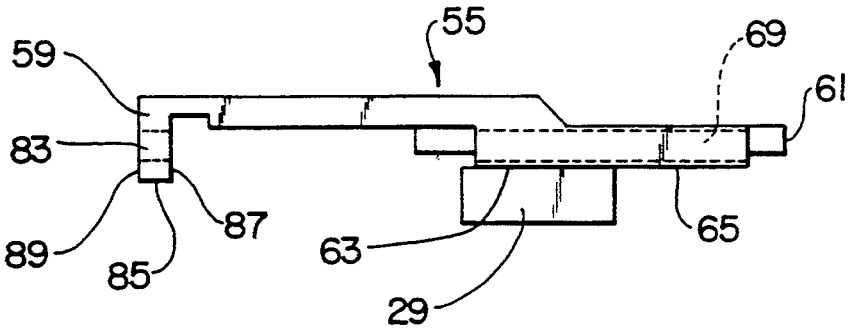
FIG. 5 is a side elevation view of the elongated member depicted in FIG. 4.
Figure 6:
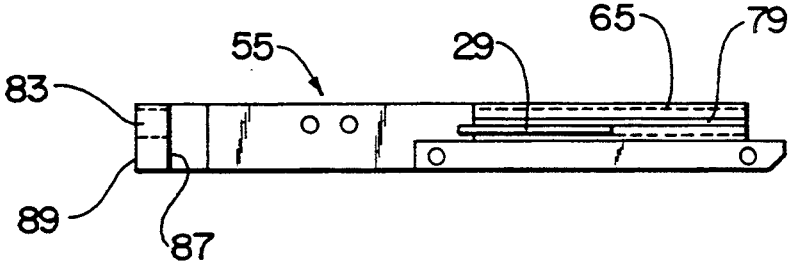
FIG. 6 is a bottom plan view of the elongated member of FIG. 5.
Figure 7:
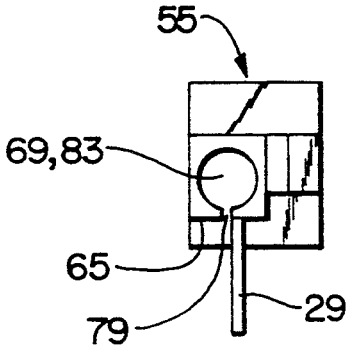
FIG. 7 is an elevation view of the elongated member of FIG. 5.
Figure 8:
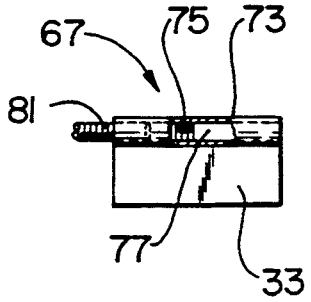
FIG. 8 is a side elevation view of the movable gate depicted in FIG. 4.
Figure 9:
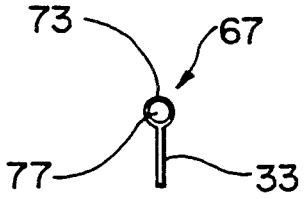
FIG. 9 is an end elevation view of the movable gate of FIG. 8.

Referring now to the drawings, FIG. 1 shows in plan view an arrangement of a rotary pellet press 1 incorporating the present invention for use in the nuclear fuel industry. A portion of the rotary pellet press 1 is shown in perspective in FIG. 2. The pellet press is located in a press enclosure 3 which may incorporate safety features (not shown), such as negative pressure, for preventing undue operator exposure to radioactive fuel material, such as pre-compacted powders of uranium dioxide. The enclosure 3 includes a vertical sliding door 5 that allows an operator to make adjustments to the pellet press. The press 1 includes a rotatable turret 7 having a plurality of circumferentially spaced dies 9. Positioned on top of the turret is a powder feed frame 11, shown in more detail in FIG. 3. The feed frame 11 has spaced apart inner and outer walls 13, 15 providing a channel 17 having a width of about 2.25 inches (5.72 cm) therebetween. The pre-compacted, granulated uranium dioxide powder 19 is delivered to the turret surface 21 via a powder feed chute 23 positioned over a central opening on the top of the feed frame 11. Gravitational delivery of powder 19 is enhanced by vibration of the feed chute 23 by means not shown. The turret 7 is rotated, by means not shown, underneath the feed frame 11, thereby bringing through the feed frame 11 a continuous stream of empty dies 9 to be filled with the powder 19. An adjustable powder flow gate 25 assembly is mounted on the feed frame 11 downstream from the powder feed chute 23. A nylon gasket 27 provides a seal between the feed frame 11 and the turret surface 21.

The adjustable gate 25, shown in isolation in FIG. 4, includes a fixed blade 29 extending from an inner surface 31 of the outer wall 15 of the feed frame 11 to a position between the inner wall 13 and outer wall 15 of the feed frame. A movable blade 33 adjacent the fixed blade 29 adjusts the size of an opening 35 in the channel 17 defined by the radially outer surface 37 of the inner wall 13 and an edge 39 of the movable blade 33. The adjustable gate 25 is aligned parallel to an upstream radius 41 of the turret 7 such that excess powder is directed towards the opening 35 by the fixed blade 29 and the movable blade 33 as it is carried through the feed frame 11 by the rotating turret. By adjusting the size of the opening 35 an operator can control the uniformity of die fill. Proper adjustment of the opening size can also prevent overfilling of the feed frame 11, which preferrably should be avoided because excess radioactive powders that spill out of the feed frame 11 create a potential for operator exposure during their removal.

At the exit of the feed frame 11 is a die wipe-off blade 43 that wipes excess powder 19 away from the dies 9 and directs the excess powder 19 towards a radially inner portion of the turret surface. Further downstream, punches (not shown) compress the powder in each die into pellets 45. Further on, the pellets 45 are pushed up to the surface 21 of the turret by means not shown, and then taken off the turret 7 by a take-off bar 47 that feeds the pellets 45 to a rotating pellet take-off disk 49. The pellets are then directed to a belt 51 which takes them to another location (not shown) for further processing. The excess powder 19 on the turret surface 31, if not in excessive amounts, is brought back into the channel 17 of the feed frame 11 by a second wipe blade 53 connected to the feed frame 11.

The adjustable powder flow gate 25 assembly has a relatively simple design. Referring now also to FIGS. 5–10, an elongated member 55, preferably machined from brass bar stock 0.75 inch square by 6.0 inches long (1.9 cm by 15.24 cm), is attached to the inner wall 13 and outer wall 15 of the feed frame 11 by fasteners 57, such as screws, just downstream from the powder feed chute 23. The elongated member 55 spans the channel 17, one end 59 extending over and beyond the outer wall 15 of the feed frame 11. Near the other end 61 a rectangular, fixed blade 29, preferably made of brass and silver soldered along its top edge 63 to the bottom side 65 of the elongated member 55, extends vertically down into the channel 17 to the surface 21 of the turret from a notch (not shown) in the outer wall 15 of the feed frame 11 to a point about 1.25 inches (3.175 cm) into the channel. The fixed blade 29, like the elongated member 55, is oriented about parallel to an upstream radius 41 of the turret 7, such that excess powder 19 is directed towards the inner wall 13 of the channel 17 by the gate 25.

The adjustable gate 25 also has a movable member 67 carried in a bore 69 in the elongated member 55, that is motivated by a screw to adjust the size of the opening 35 in the channel 17. The movable member 67 preferably includes a rectangular, movable brass blade 33 about 1.5 inches (3.81 cm) long, 0.5 inches (1.27 cm) high, and about 0.025 inches (0.0635 cm) thick. The movable blade 33 is aligned adjacently parallel with the fixed blade 29. According to this preferred embodiment, the movable blade 33 is silver soldered along its top edge 71 to a tapped member 73 made of 0.25 inch (0.635 cm) diameter steel bar stock having a tapped bore 75 tapped with a 0.164–32 UNC thread 0.5 inches (1.27 cm) deep meeting a 0.171 inch (0.434 cm) clear bore 77 from the opposite end of the tapped member 73. The tapped member 73 is slidably carried in the bore 69 of the elongated member 55 that is located proximate the fixed blade 29. A slot 79 for receiving the movable blade 33 extends into the bore 69 from the bottom 65 of the elongated member 55. This arrangement prevents rotation of the movable member 67.

The screw that effects motion of the movable member 67, and thus the movable blade 33, is preferably a first end of a rotatable 0.25 inch (0.635 cm) diameter steel shaft 81 threaded for a length of 1.38 inches (3.5 cm) to match the tapped member 73. The shaft 81 is carried by the tapped member 73 at the threaded end and by a shaft guide 83 bored through an arm 85 extending transversely down from the end 59 of the elongated member 55 beyond the outer wall 15. The arm 85 has spaced apart inner 87 and outer 89 faces.

The means for maintaining the shaft in a selected rotational position preferrably includes a detent member 91, such a spur gear 93, mounted on the shaft 81 adjacent the outer face 89 of the arm 85. The gear can be Browning pulley #18XLB037 with flanges removed. The gear 93, which preferrably has an annular member 95, is attached to the shaft 81 by means of a set screw 97 through the annular member 95.

A second annular member, or shaft collar 99, positioned adjacent the inner face 59 of the arm 55 prevents movement of the shaft 81 out of the adjustable gate 25 assembly. The shaft collar 99 can also be affixed to the shaft 81 by means of a set screw 97 as shown. Fine movements of the gate are accomplished by manipulating finger gripping means 101, preferably a knurled knob, attached to the free end of the shaft.

Figure 10:
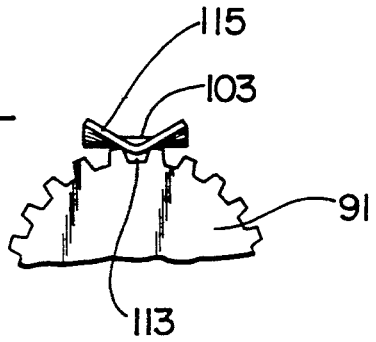
FIG. 10 is an end view of a preferred embodiment of the bias member.

The means for maintaining the shaft in a selected rotational position also preferably includes an elongated, leaf spring bias member 103 fastened at a first end 105 to the top 107 of the elongated member 55 by two screws 109. A second end 111 of the bias member 103 is adapted for insertion in the detents 113 between selected adjacent teeth of the spur gear 93. The bias member 103 can be fabricated of 0.02 inch (0.05 cm) stock spring steel, about 3 inches (7.62 cm) long and 0.5 inches (1.27 cm) wide. As depicted in FIG. 10, a one inch (2.54 cm) long V-shaped crease 115 in the second end 111 of the leaf spring 103 nestles in a detent 113 between the selected teeth of the gear 93. The leaf spring 103 is less tensioned in this position than when not nestled in a detent.

To adjust the opening in the channel an operator simply turns the knurled knob 101 with the fingers of one hand while the rotary pellet press is operating. Rotation of the knob 101 rotates the shaft 81 and thereby rotates the gear 93. The rotation of the shaft also moves the movable member 67. Movement of the gear lifts the V-shaped crease 115 of the leaf spring 103 out of the gear detent 113 in which it had originally nestled. The V-shaped crease 115 then lowers its potential energy by settling into the next detent 113 that is presented beneath it by the rotation of the gear 93. The operator continues to rotate the knob 101, thereby moving the movable member 67, until the opening 35 is the desired size. The V-shaped crease 115 of the bias member 103 stays nestled in a detent 113 between a newly selected pair of gear teeth. The gear 93, being held in position by the V-shaped crease 115 of the bias member 103, will not rotate further, thus, the movable member 67 will also be held in place. Because the spring tension in the bias member 103 is lower when the V-shaped crease 115 is nestled in a detent of the gear 93 than when not so positioned, the bias member 103 normally holds the gear 93 in place.

This arrangement has been able to withstand the extreme vibrations of a pellet press operating at over 24 rpm without coming out of adjustment. The spring tension in the leaf spring 103 must be overcome to knock the V-shaped crease 115 out of the selected detent 113 of the gear 93. Even if the V-shaped crease 115 were to be dislodged from the selected detent 113 by a severe vibration, it would tend to quickly settle back into place because the potential energy of the system is minimized when it is positioned in a detent.

With the above recited arrangement (32 screw threads per inch (12.6 per cm) and a gear having 18 detents) an operator can make reproducible adjustments to the size of the opening 35 of as little as +/−0.0017 inch (+/−0.0043 cm). Even finer adjustments can be obtained with other arrangements of screw threading and gear selection. This type of adjustable powder flow gate 25 is resistant to vibrational loosening because set screws are not used to keep the movable blade 33 in place.

Using the same simple energy principles, one skilled in the art can use a variety of mechanical arrangements to maintain the rotational position of the shaft. For example, a bias member that has a lower gravitational potential when inserted in a detent than when in a raised position out of a detent can also be used.

In addition to the foregoing, one skilled in the art may be able to make modifications and variations, in whole or in part, to the explained embodiments without departing from the true scope and spirit of the invention, and it is intended that this invention be limited only by the scope of the claims.

We claim:

1. An adjustable gate for controlling the amount of powder that flows into a fill area of a feed frame on the surface of a rotating turret of a rotary pellet press by adjustably changing the size of an opening of a channel in the feed frame, comprising:

a first member capable of linear movement across the channel so as to change the size of the opening; and adjustable screw means for effecting the linear movement of the first member, comprising a rotatable shaft having a screw connection to the first member for linearly moving the first member by rotating the shaft, first means connected to the feed frame and supporting the shaft for maintaining the shaft in a fixed translational position relative to the feed frame when the shaft is rotated and second means for maintaining the shaft in a selected rotational position.

2. The adjustable gate of claim 1, wherein the second means includes:

a detent member fixedly mounted on the rotatable shaft, comprising a plate having a plurality of circumferentially spaced detents on a radius coaxial with the shaft; and bias means connected to the feed frame, comprising a bias member movable between a first position engaged in a selected detent and a second position disengaged from each of the detents.

3. The adjustable gate of claim 2, wherein the bias means has a potential energy that is lower in the first position of the bias member than in the second position of the bias member.

4. The adjustable gate of claim 3, wherein the plate comprises a toothed gear, the bias member comprises an elongated spring member having a first end fixed relative the feed frame and a second end movable between the first and second positions.

5. An adjustable powder flow gate for a rotary pellet press, the press comprising a rotatable turret having a horizontal upper surface and a plurality of circumferentially spaced apart dies extending from the upper surface into the turret, a feed frame at a fixed position adjacent the upper surface of the turret for receiving powder and directing powder on the upper surface of the turret, the feed frame having spaced apart inner and outer walls between which the powder passes as the turret rotates, the inner wall being closer to a turret axis of rotation than the outer wall, the powder flow gate comprising:

an elongated member forming a bridge spanning the inner and outer walls, a channel being defined by the upper surface of the turret, the elongated member and the inner and outer walls, wherein the dies pass below the channel as the turret rotates;

a first blade depending from the elongated member and having a straight edge positioned adjacent the upper surface of the turret such that the first blade blocks a first portion of the channel extending from the outer wall to a position between the inner and outer walls;

a rotatable shaft carried by the elongated member in about parallel alignment with the elongated member, the shaft having a first end at a position radially outside the outer wall with respect to the turret axis of rotation and having a threaded second end at a position radially between the inner and outer walls with respect to the turret axis of rotation;

first means for maintaining the shaft in a fixed translational position relative to the elongated member;

second means for maintaining the shaft in a selected rotational position;

a movable gate, comprising:

a member having a tapped bore receiving the threaded second end of the rotatable shaft; and a second blade affixed to the member having a tapped bore, extending across a second portion of the channel overlapping the first portion of the channel, aligned parallel to and overlapping the first blade and having a straight edge positioned adjacent the upper surface of the turret, wherein rotation of the shaft provides a screw action to the member having a tapped bore that effects straight line motion of the movable gate across the channel to adjust the size of an opening in the channel defined by the inner wall, the second blade, the upper surface of the turret and the elongated member.

6. The adjustable powder flow gate of claim 5, the second means comprising:

a detent member mounted on the shaft between the first end of the shaft and the outer wall of the feed frame, including a plurality of circumferentially spaced detents on a radius coaxial with the shaft; and bias means connected to the elongated member, comprising a bias member movable between a first position engaged in a selected one of the detents such that rotation of the shaft and movement of the movable gate are inhibited and a second position disengaged from each of the detents such that rotation of the shaft and movement of the movable gate are permitted.

7. The adjustable powder flow gate of claim 6, wherein the bias means has a potential energy that is lower when the bias member is in the first position than when the bias member is in the second position.

8. The adjustable powder flow gate of claim 7, wherein the detent member comprises a toothed gear, the bias member comprises a spring having a first end adapted to engage between selected adjacent teeth of the gear in the first position and to disengage from the selected adjacent teeth of the gear in the second position.

9. The adjustable powder flow gate of claim 6, the first means comprising spaced apart first and second shaft guides for carrying the shaft, each of the shaft guides being defined by the elongated member, the first shaft guide including a bore in an arm of the elongated member the arm being spaced apart from a first side of the outer wall of the feed frame distal from the inner wall, the bore extending between a first surface of the arm facing the first Side of the outer wall and a second surface spaced from the first surface and distal from the first side of the outer wall, and spaced apart first and second annular members fastened to the shaft, the detent member being connected to the first annular member and positioned adjacent the second surface of the arm, the second annular member being positioned adjacent the first surface of the arm.

10. The adjustable powder flow gate of claim 5, wherein the elongated member further comprises means for preventing rotation of the movable gate about the axis of the shaft.

11. The adjustable powder flow gate of claim 10, wherein the means for preventing rotation of the movable gate comprises a longitudinal bore in the elongated member slidably supporting the member having a tapped bore, and a longitudinal slot extending in the elongated member between the longitudinal bore and the channel and through which the second blade extends, the slot acting as a stop for preventing rotational movement of the second blade about the axis of the shaft.

12. The adjustable powder flow gate of claim 11, the second means comprising:

a detent member fixedly mounted on the rotatable shaft, including a plurality of circumferentially spaced detents on a radius coaxial with the shaft; and bias means connected to the elongated member, including a bias member movable between a first position engaged in a selected one of the detents such that rotation of the shaft and movement of the movable gate are inhibited and a second position disengaged from each of the detents such that rotation of the shaft and movement of the movable gate are permitted.

13. The adjustable gate of claim 12, wherein the bias second means has a potential energy that is lower in the first position than in the second position.

14. The adjustable gate of claim 13, wherein the detent member comprises a toothed gear, the bias member comprises an elongated spring having a first end fixed relative to the elongated member and a second end movable between the first and second positions.

15. The adjustable powder flow gate of claim 14, the first means comprising spaced apart first and second shaft guides for carrying the shaft, each of the shaft guides being defined by the elongated member, the first shaft guide including a bore in an arm of the elongated member spaced apart from a first side of the outer wall of the feed frame distal from the inner wall, the bore extending between a first surface of the arm facing the first side of the outer wall and a second surface spaced from the first surface and distal from the first side of the outer wall, and spaced apart, first and second annular members fastened to the shaft, the toothed gear being attached to the first annular member and positioned adjacent the second surface of the arm, the second annular member being positioned adjacent the first surface of the arm.

16. The adjustable powder flow gate of claim 15, further comprising means for rotating the shaft adapted for finger-gripping and fastened to the shaft proximate the first end.

17. The adjustable powder flow gate of claim 16, wherein the means for rotating the shaft comprises a knurled collar.

* * * * *